US005715998A

United States Patent [19]

Sula

[11] Patent Number: 5,715,998

[45] Date of Patent: Feb. 10, 1998

[54] COMBINED HUMIDITY GAUGE AND FAN FOR A HUMIDOR

[76] Inventor: Suleiman S. Sula, 606 Bowling Green, Moorestown, N.J. 08057

[21] Appl. No.: 733,160

[22] Filed: Oct. 17, 1996

[51] Int. Cl.[6] ..... A24B 9/00

[52] U.S. Cl. ..... 236/44 A; 236/46 A; 261/30; 261/104

[58] Field of Search ..... 236/44 A, 46 A; 261/30, 99, 104, 107; 312/31; 131/302, 303

[56] References Cited

U.S. PATENT DOCUMENTS

| | | | |
|---|---|---|---|
| 1,987,373 | 1/1935 | Shapiro | 312/31 |
| 2,058,800 | 10/1936 | Jasper | 312/31 |
| 2,384,016 | 9/1945 | Dishner | 261/30 |
| 2,614,820 | 10/1952 | Boydjieff | 261/30 |
| 2,977,171 | 3/1961 | Gleason | 312/31 |
| 3,023,064 | 2/1962 | Sosa | 312/31 |
| 3,135,565 | 6/1964 | Bingham | 312/31 |
| 3,336,093 | 8/1967 | Phelps | 312/31.1 |
| 4,008,930 | 2/1977 | Swainson | 312/31.1 |
| 4,428,892 | 1/1984 | Berliner | 261/99 |
| 4,951,555 | 8/1990 | Hahn et al. . | |
| 5,400,612 | 3/1995 | Hedges | 62/171 |

*Primary Examiner*—William E. Tapolcai
*Attorney, Agent, or Firm*—Norman E. Lehrer

[57] ABSTRACT

A device for circulating moist air throughout the interior of a humidor. The device includes a housing which has a front surface and a rear surface. A humidity gauge is mounted within the housing. A moisture containing element is also mounted within the housing. Positioned between the rear surface of the housing and the moisture containing element is a fan. The fan is adapted to circulate a stream of air through the moisture containing element, through the front surface of said housing and throughout the interior of the humidor.

10 Claims, 1 Drawing Sheet

COMBINED HUMIDITY GAUGE AND FAN FOR A HUMIDOR

BACKGROUND OF THE INVENTION

The present invention is directed toward a combined humidity gauge and fan and, more particularly, to such a combined humidity gauge and fan which is adapted to be secured to the inside of a humidor.

Cigar smokers frequently store their cigars in a device known as a humidor in order to prevent the cigars from drying out, becoming brittle, and loosing their taste. A humidor is a wooden container which typically includes a moisture containing element such as a moistened sponge. The moisture containing element supplies moisture to increase the internal humidity of the humidor. U.S. Pat. Nos. 5,400,612, 4,008,930, 3,336,093, 2,460,554, 1,704,908, 1,502,733, 1,298,415 and 280,447 disclose humidors having some form of moisture supplying means.

Periodically, the moisture containing element must be re-moistened in order to prevent the amount of moisture in the humidor from dropping below a level that would cause the cigars, or other tobacco products contained therein, to dry out. In order to readily determine the moisture level in the humidor, humidity gauges or hygrometers are often positioned therein.

The air which immediately surrounds the moisture containing element has the highest moisture content in the humidor. Since the moisture containing element is typically secured to the inside of the humidor lid, it follows that the upper portion of the humidor, which is closest to the lid, has a higher humidity level than the bottom portion of the same. Accordingly, cigars located on or near the bottom of the humidor will be subjected to lower humidity levels than cigars located closer to the lid of the humidor and their moisture content may not sufficiently be retained.

Moreover, the reading obtained by a humidity gauge contained in the humidor will be significantly affected by the location of the gauge. Specifically, if the humidity gauge is located in close proximity to the moisture containing element it will provide a higher humidity reading than it will if the gauge is located a relatively large distance from the moisture containing element.

SUMMARY OF THE INVENTION

The present invention is designed to overcome the deficiencies of the prior art discussed above. It is an object of this invention to provide a device which circulates moist air uniformly throughout a humidor.

In accordance with the illustrative embodiments, demonstrating features and advantages of the present invention, there is provided a device for circulating moist air uniformly throughout the interior of a humidor. The device includes a housing which has a front surface and a rear surface. A humidity gauge is mounted within the housing. Also mounted within the housing is a moisture containing element. Positioned between the rear surface of the housing and the moisture containing element is a fan. The fan is adapted to circulate a stream of air through the moisture containing element, through the front surface of said housing and throughout the interior of the humidor.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
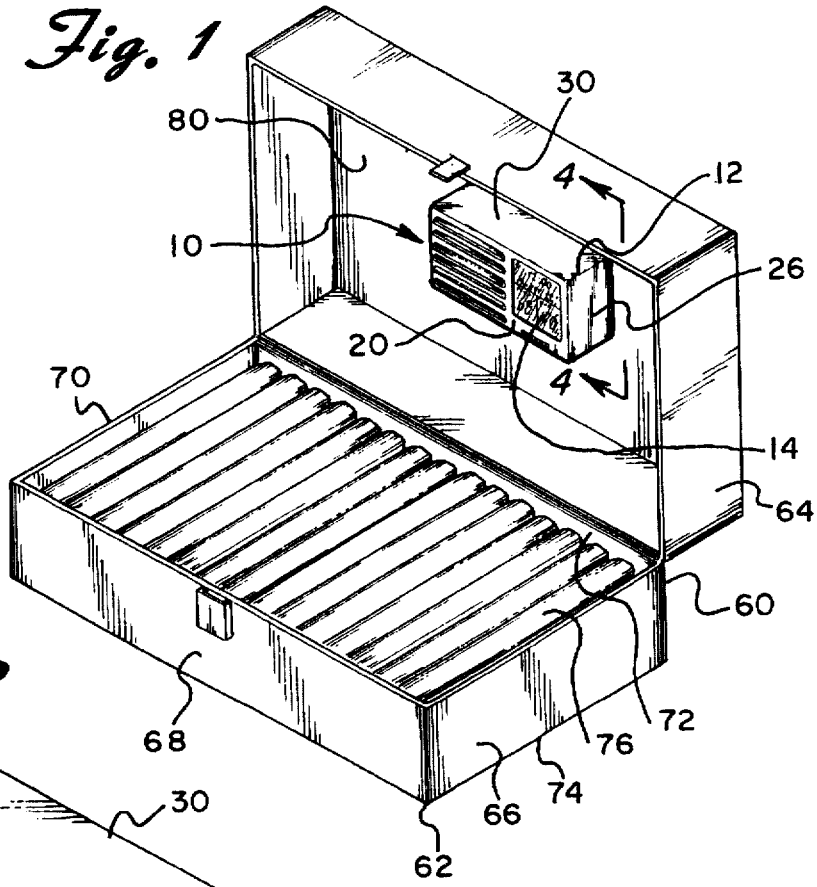
FIG. 1 is a perspective view of the combined humidity gauge and fan shown secured to the inside of a cigar humidor lid.

Referring now to the drawings in detail wherein like reference numerals have been used throughout the various figures to designate like elements, there is shown in the figures a device for circulating moist air throughout a humidor constructed in accordance with the principles of the present invention and designated generally as 10.

Figure 2:
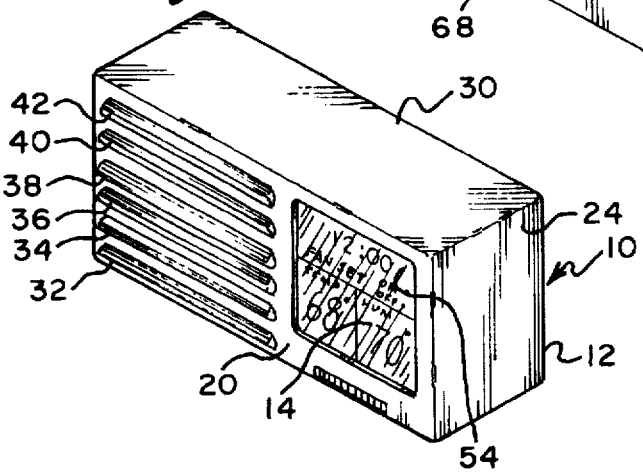
FIG. 2 is a front perspective view of the combined humidity gauge and fan according to the present invention.
Figure 3:
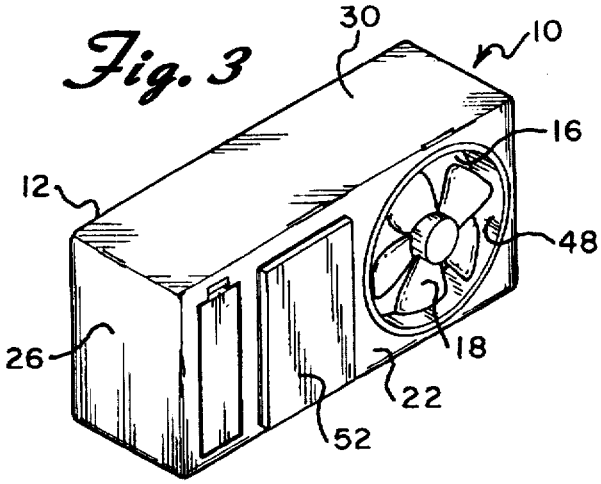
FIG. 3 is a rear perspective view of the combined humidity gauge and fan according to the present invention.
Figure 4:
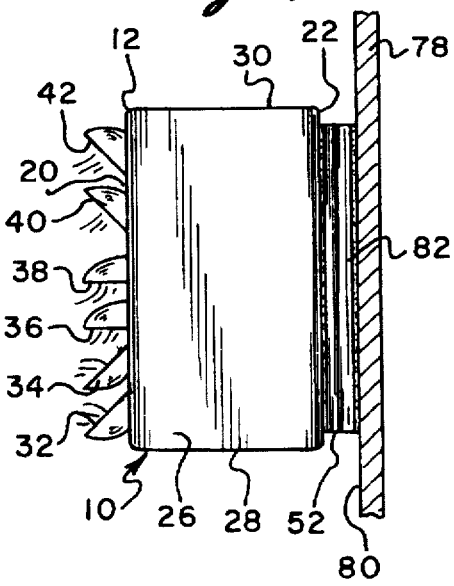
FIG. 4 is a side elevational view of the combined humidity gauge and fan taken along lines 4—4 of FIG. 1.

The device 10 essentially comprises a housing 12, a humidity gauge 14, a moisture containing element 16 and a fan 18 (FIGS. 2 and 3). The housing 12 preferably includes a front surface 20, a rear surface 22, a pair of opposing end walls 24 and 26, a bottom wall 28 and a top wall 30. The front surface 20 of the housing 12 includes a plurality of angled air vents 32, 34, 36, 38, 40, 42. In the preferred embodiment, air vents 32 and 34 are preferably angled upwardly at a 45° angle, air vents 36 and 38 are angled downwardly at a 90° angle, and air vents 40 and 42 are angled downwardly at a 45° from the front surface 20 of the housing 12. However, each of the vents can extend from the front surface of the housing at various different angles. Further, the number of air vents can be increased or decreased. The preferred dimensions of the housing are about 3" (7.6 cm) long, 1.5" (3.8 cm) high, and 1" (2.54 cm) wide.

The rear surface 22 of the housing includes a fan opening 48 as shown in FIG. 3. The fan 18 is placed in the opening 48 and is secured in the housing 12. The fan is preferably powered by a battery located within the housing. A ferromagnetic plate 52 is preferably adhesively secured to the rear surface 22 of the housing 12. The ferromagnetic plate allows the device 10 to be magnetically secured to a magnetic means as more fully described below.

The moisture containing element 16 is disposed between the fan 18 and the front surface 20 of the housing 12 adjacent the plurality of vents 32, 34, 36, 38, 40, and 42. In the preferred embodiment, the moisture containing element 16 is preferably in the form of a moistened sponge. Periodically, the sponge must be re-moistened. This is accomplished by supplying water through the fan opening 48 and directly onto the sponge 16. However, other openings can be formed in the housing 12 into which water can be supplied in order to re-moisten the sponge.

In the preferred embodiment, the humidity gauge 14 includes timing means 54 electrically connected to the fan 18 for periodically turning on and off the same at predetermined intervals. Further, the humidity gauge preferably includes a thermometer for measuring the temperature of the air surrounding the device 10.

In order to facilitate an understanding of the principles associated with the forgoing device, its operation will now be briefly described. The device 10 is releasably secured to the interior of a storage compartment such as a cigar humidor 60. The humidor 60 includes a container 62 and a cover or lid 64 (FIG. 1). The container 62 includes four side walls 66, 68, 70, 72, a bottom wall 74, and an open top. The container 62 defines a storage compartment for tobacco products such as cigars 76. The lid 64 is hingedly connected to side wall 72. The lid includes an inside surface 80 to which a magnetic strip 82 is adhesively secured. The ferromagnetic plate 52 on the rear surface 22 of the housing 12 is magnetically attracted to the magnetic strip 82 so that the device 10 can be releasably secured to the inside surface 80 of the humidor lid 64.

Once the humidor 60 is filled with cigars 76, the lid 64 is closed. The timing mechanism 54 associated with the humidity gauge 14 automatically turns the fan 18 on and off at predetermined intervals. For example, the fan 18 may turn on for several minutes every hour or two. The fan circulates a stream of air through the moisture containing element 16, through the vents 32, 34, 36, 38, 40, and 42 in the front surface 20 of the housing 12 and into the storage compartment of the container 62 so moisture from the moisture containing element 16 will be uniformly distributed throughout the storage compartment of the humidor 60. The angled vents ensure that air from the fan is emitted from all directions so that moist air is evenly circulated.

When the moisture containing element 16 dries out, the device 10 is separated from the inside surface of the humidor lid 64 so that water can be supplied through the fan opening 48 in the rear surface 22 of the housing 12 and onto the moisture containing element 16. Thereafter, the ferromagnetic plate 52 is once again positioned against the magnetic strip 82 so that the device 10 is magnetically secured to the inside surface 80 of the lid 64 of the humidor 60.

It should be noted that the device 10 could be secured to the inside surface 80 of the lid 64 by other means. For example, mating hook and loop fastening strips (Velcro) could be utilized to secure the device 10 to the lid 64 of the humidor 60.

Furthermore, while the moisture containing element 16 has been described as being located within the housing 12 of the device 10, it should be readily apparent that the moisture containing element 16 can be located outside of the housing and can be secured directly to the inside of the lid 64 of the humidor 60 in a conventional manner. Similarly, the humidity gauge 14 can also be located outside of the housing 12.

The present invention may be embodied in other specific forms without departing from the spirit or essential attributes thereof and accordingly reference should be made to the appended claims rather than to the foregoing specification as indicating the scope of the invention.

What is claimed is:

1. A device for circulating moist air throughout a humidor comprising:

a housing having an opening therein;

a combined humidity gauge and timing means mounted within said housing;

humidifying means mounted within said housing adjacent said humidity gauge and timing means, and fan means mounted within said housing for circulating a stream of air through said humidifying means and through said opening in said housing, said fan means being electrically connected to said timing means.

2. The device of claim 1 wherein said humidity gauge further includes a thermometer for measuring the temperature of said housing.

3. The device of claim 1 wherein said humidifying means includes a moisture containing sponge.

4. A humidor for storing tobacco products comprising:

a container including a bottom wall, a plurality of side walls, and an open top, said container defining a storage compartment;

a lid hingedly connected to one of said side walls of said housing, said lid having an inside surface;

a housing having an opening therein, said housing including a rear surface and a front surface;

means for securing said rear surface of said housing to said inside surface of said lid;

a combined humidity gauge and timing means mounted in said housing;

humidifying means mounted in said housing adjacent said humidity gauge and timing means, and fan means within said housing for circulating a stream of air through said humidifying means, out said opening in said housing and into said storage compartment of said container, said fan means being electrically connected to said timing means.

5. The humidor of claim 4 wherein said humidity gauge further includes a thermometer for measuring the temperature of said storage compartment.

6. The humidor of claim 4 wherein said housing includes an opening adjacent said humidifying means for allowing the same to be periodically re-moistened.

7. The humidor of claim 4 wherein said securing means includes first and second magnetic strips, said first and second magnetic strips being magnetically attracted to one another, said first magnetic strip being secured to said housing and said second magnetic strip being secured to said inside surface of said lid.

8. The humidor of claim 4 wherein said humidifying means includes a moisture containing sponge.

9. A humidor for storing tobacco products comprising:

a container including a bottom wall, a plurality of side walls, and an open top, said container defining a storage compartment;

a lid hingedly connected to one of said side walls of said humidor, said lid having an inside surface;

humidifying means mounted to said inside surface of said lid;

a housing having an opening therein, said housing including a rear surface and a front surface;

securing means for securing said rear surface of said housing to said inside surface of said lid;

a combined humidity gauge and timing means mounted within said housing, and fan means within said housing for circulating air throughout said humidor wherein said fan means is electrically connected to said timing mean.

10. The humidor of claim 9 wherein said securing means includes first and second magnetic strips, said first and second magnetic strips being magnetically attracted to one another, said first magnetic strip being secured to said housing and said second magnetic strip being secured to said inside surface of said lid.

* * * * *